United States Patent [19]

Shull

[11] 4,302,014

[45] Nov. 24, 1981

[54] GOLF TRAINING DEVICE

[76] Inventor: Michael S. Shull, 2570 N. Kentucky Ave., Evansville, Ind. 47711

[21] Appl. No.: 142,037

[22] Filed: Apr. 21, 1980

[51] Int. Cl.[3] ..... A63B 69/36

[52] U.S. Cl. ..... 273/183 B; 273/190 R

[58] Field of Search ..... 273/190 R, DIG. 17, 273/183 B; 35/29 A; 434/252

[56] References Cited

U.S. PATENT DOCUMENTS 1,636,753 7/1927 Olcott ..... 273/190 R 3,770,280 11/1973 Straus ..... 273/190 R X

*Primary Examiner*—George J. Marlo

*Attorney, Agent, or Firm*—Warren D. Flackbert

[57] ABSTRACT

A training device having particular adaptability to the game of golf which serves to selectively control and limit head movement of the student during practice swinging and, therefore, affords proper instruction relative to hip-shoulder and turning movement, balance, timing, effective muscle development and usage and, as well, a reduction in training time. The invention is broadly defined by a selectively removable flexible band surrounding the student's head mounted on an arm extending outwardly from a vertically adjustable support mounted on a base. The latter includes provisions for positive positioning at the training site. The headband, typically made from fabric, is mounted on rotatable metal or wire segments interconnecting loops in the fabric and holes in a mounting plate, where the headband serves to limit or control the position of the trainee's head or indicates to the trainee information as to existing head movement. The overall unit is positioned by a spike and anchor pin arrangement.

6 Claims, 7 Drawing Figures

GOLF TRAINING DEVICE

As is known, it is important that a golfer receives adequate and sufficient instruction in the fundamentals of the game to present an optimum level of skill on the course. In this connection, various teaching and/or training arrangements have been suggested over the years, being directed to improvements in various areas of performance as, for example, stance, the gripping of the clubs, arm movement/control in combination with the actual swing for effective driving and putting, and the like.

The invention is directed to another primary area of concern, i.e. the control of head movement during swinging. In this connection, it is important that the golfer's head and vision be directed to the golf ball, and remain in such position, during the course of take away, downswing and follow-through movement, allowing head rotation during follow-through.

While other approaches have been considered in connection with the aforesaid problem, the invention at hand presents a ready and positive solution, being quickly adaptable to be received on and to conform to a student's head size, limiting and/or controlling head movement during swinging, and presenting direct placement at the desired driving/training site. In this latter connection, the support for the head guide or control structure of the invention is vertically adjustable to accommodate for the height of the student and the overall unit is readily movable from one location to another.

In order to afford the desired control of head movement, and briefly, the invention utilizes a flexible band, typically made from elasticized cotton or canvas, secured in position, by "velcro" or other fastening means, for ready positioning on the student's head and interconnecting, through releasable metal or wire segments, a support located on an arm member which extends outwardly from a vertically adjustable post supported on a base. The aforesaid metal or wire segments are received in loops secured to the flexible headband and in openings in a rotatable plate forming part of the support. The overall structure is light in weight and is readily disassembled to permit the laundering of the headband.

In other words, the invention avoids the use of heavy overlying movement control structure which might prove objectionable to the trainee, i.e. present a feeling of mass or undue "superstucture" restraint in contrast to the instant arrangement which presents no real physical demands, except for the presence of the lightweight band on the user's head. In any event, with any unwanted head movement during a swing, the flexible band easily slips from the user's head without harm or bruising.

In any event, a better understanding of the present invention will become more apparent from the following description, taken in conjunction with the accompanying drawing, wherein FIG. 1 is a view in side elevation showing a golf training device in accordance with the teachings of the invention, where a student is shown in phantom for environmental purposes;

Figures 1, 2, 3, 4, 5, 6, 7:
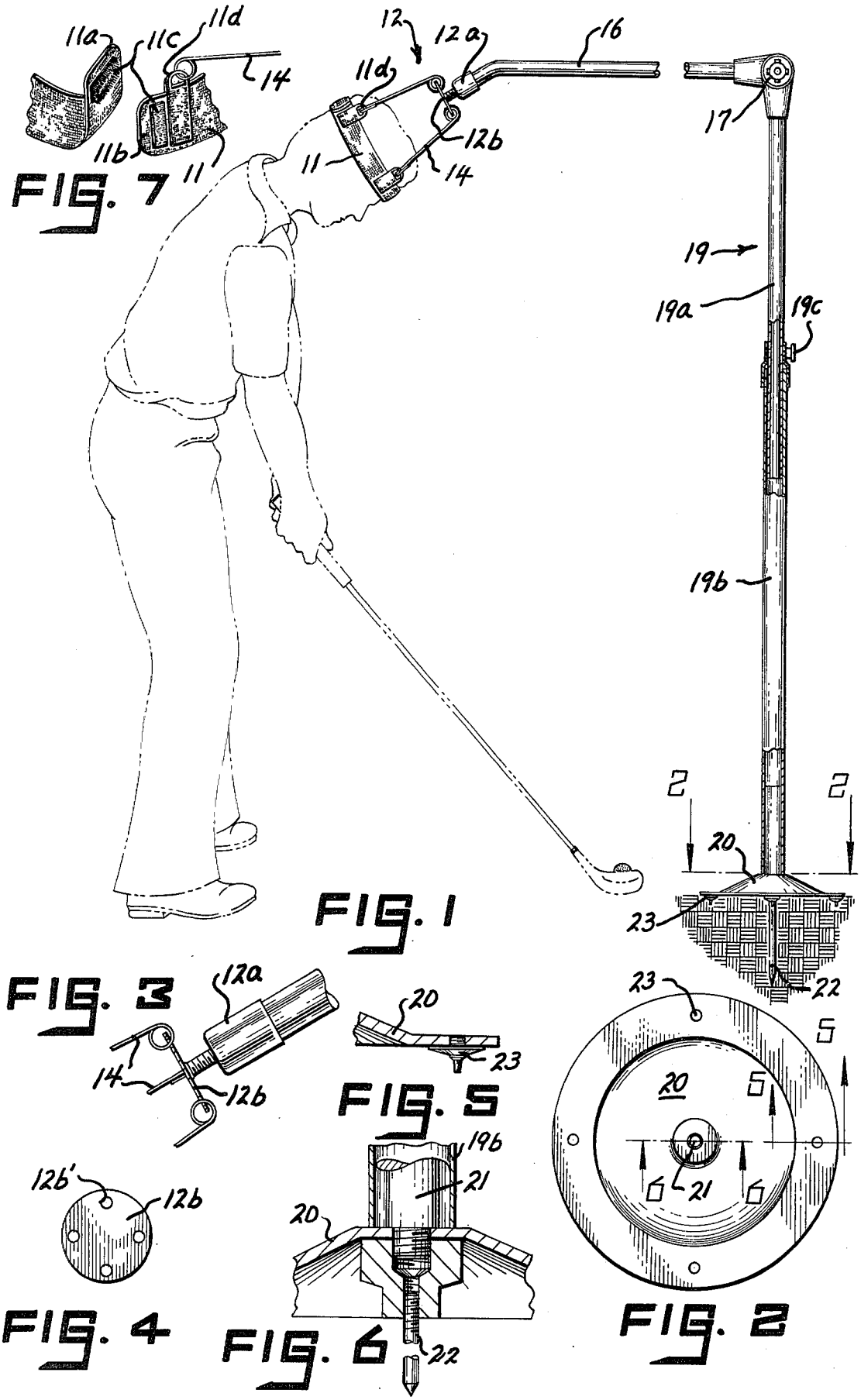
FIG. 2 is a top plan view of the base forming part of the golf training device, generally taken at line 2—2 on FIG. 1 and looking in the direction of the arrows.
FIG. 3 is an enlarged view in side elevation showing the support joint for the head movement control arrangement.
FIG. 4 is a view in front elevation, looking from left to right in FIG. 3, showing the wire segment receiving plate forming part of the support joint.
FIG. 5 is a view in vertical section, partly fragmentary, showing further details of the base of the golf training device, taken at line 5—5 on FIG. 2 and looking in the direction of the arrows.
FIG. 6 is another view in vertical section, also partly fragmentary, showing further details of the base, in this instance, however, taken at line 6—6 on FIG. 2 and looking in the direction of the arrows; and, FIG. 7 is an enlarged fragmentary view showing headband details, including representative fastening means and an assembled support.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications of the illustrated device and such further applications of the principles of the invention as illustrated therein being contemplated as would normally occur to one skilled in the art to which the invention relates.

Referring now to the figures, the golf training device of the arrangement comprises, basically, a flexible band 11 adapted to be selectively secured about the head of the student or trainee; a support member or joint 12 mounting metal or wire segments 14 detachable secured to the aforesaid flexible headband 11; and, an arm 16 extending outwardly from a vertical support 19 mounted on a base 20. As apparent, therefore, the invention employs a minimum number of components arranged in a manner to provide simplicity of usage and ready relocation to and from training sites.

More specifically, and with particular reference to FIGS. 1 and 7, the headband 11, typically made from elasticized canvas, cotton or similar material, is caused to surround the head of the user, being of a sufficient length to accommodate various head sizes. The free end portions **11*a* and 11*b* of the flexible band 11 are secured together by fastening means 11*c*, such as conventionally known "velcro" material. Loop elements 11*d* are peripherally arranged about the headband 11, where such removably receive the ends of metal or wire segments 14 extending from the headband 11 to the support member or joint 12**.

In this connection, the latter typically comprises (see FIG. 3) a tubular body portion **12*a* to which a plate 12*b* (see also FIG. 4) is threadedly received for rotation and removal. The rotatable plate 12*b* includes a series of openings 12*b*' which receive opposite ends of the metal or wire segments 14**, also in a removable manner.

In other words, the preceding components, grouped together to present a form of headgear, are light in weight, readily positioned on the user's head and permit limited "swaying" head movement. The limited movement is occasioned by the movement of the metal or wire segments 14, i.e. if such movement becomes excessive, the head slips from the flexible headband 11, meaning that the student or trainee is not properly accomplishing minimal head movement during the swinging of the club.

The aforesaid support joint or member 12 is disposed on a downwardly sloping end of arm 16, typically at a 30° angle, extending, through angle section 17 (which may be adjustable), from the vertical support 19 mounted on the base 20. Actually, in the preferred form of the invention, the support 19 is defined by sections 19*a* and 19*b*, in a telescopic relationship, where threaded means, as a set screw 19*c*, or an alternative pressure locking member, permits the vertical adjustment of the support 19 to any desired height.

As further evident in FIG. 6, and also in connection with FIGS. 2 and 5, the lower section 19*b* of support 19 is received on a tubular member 21 which is threadedly secured into the central area of the base 20. A spike 22, also threadedly secured to the base 20, extends into the earth below (again see FIG. 1). As a matter of further positive positioning, the base 20 includes downwardly extending anchoring pins 23, threadedly secured to the undersurface thereof, also grasping the earth to prevent base 20 rotation. In other words, the preceding positively establishes the location of the base 20 of the device at the desired training site or, alternatively, the base 20 can be permanently mounted by other arrangements (not shown).

In other words, it should be evident that the invention permits straightforward instruction in proper head placement during golf club swinging or driving action. No cumbersome headgear is involved and, moreover, if the trainee's head moves from the preselected desired area, the headband 11 becomes released because the metal or wire segments 14 exert a pulling action.

Additionally, and as stated, the height of the head receiving portion of the structure can be adjusted by means of the telescopic arrangement of the vertical support 19, where the base 20 is positively maintained at a predesired site. In other words, the invention represents simplicity and yet effectiveness.

The training device described above is susceptible to various changes within the spirit of the invention as, for example, the manner of vertically adjusting the support 19; the configuration and anchoring of the base 20; the type of connection between the vertical support 19 and the arm 16; the number of metal or wire segments 14 employed; and, the like. Thus, the preceding should be considered illustrative and not as limiting the scope of the following claims:

I claim:

1. A golf training device serving head movement limiting purposes comprising a head receiving portion, an arm supporting said head receiving portion, and a vertical support mounted on a base positioning said arm, said head receiving portion defined as a lightweight flexible band secured around and selective to the size of the head of the trainee and releasable therefrom upon excessive head movement, a rotatable plate mounted at the end of said arm, and metal segments interconnecting said rotatable plate and said lightweight flexible band controlling movement of said head of said trainee, said rotatable plate having a series of openings and said lightweight flexible band having a series of loops interconnected by said metal segments.

2. The golf training device of claim 1 where said flexible band has free ends secured together by fastening means.

3. The golf training device of claim 1 where said support is vertically adjustable.

4. The golf training device of claim 1 where said base includes a downwardly extending ground engaging spike and a selective pattern of anchor pins.

5. The golf training device of claim 1 where an angle element connects said arm and said support.

6. The golf training device of claim 1 where said end of said arm which receives said rotatable plate slopes downwardly at a preselected angle.

* * * * *